US006474958B2

(12) United States Patent
Nathan

(10) Patent No.: US 6,474,958 B2
(45) Date of Patent: Nov. 5, 2002

(54) HIGH-PRESSURE CLEANER WITH CLAMPING ELEMENT FOR RECIPROCATING PUMP

(75) Inventor: Robert Nathan, Backnang (DE)

(73) Assignee: Alfred Kaercher GmbH & Co., Winnenden (DE)

( * ) Notice: Subject to any disclaimer, the term of this patent is extended or adjusted under 35 U.S.C. 154(b) by 0 days.

(21) Appl. No.: 09/884,857

(22) Filed: Jun. 19, 2001

(65) Prior Publication Data

US 2002/0006340 A1 Jan. 17, 2002

Related U.S. Application Data

(63) Continuation of application No. PCT/EP99/07831, filed on Oct. 15, 1999.

(30) Foreign Application Priority Data

Dec. 22, 1998 (DE) ..... 198 59 336

(51) Int. Cl.[7] ..... F04B 1/12; F04B 17/00
(52) U.S. Cl. ..... 417/269; 417/360
(58) Field of Search ..... 417/269, 360, 417/454, 569; 92/71, 128, 171.1

(56) References Cited

U.S. PATENT DOCUMENTS 4,394,111 A * 7/1983 Wiese et al. ..... 165/122
4,583,921 A * 4/1986 Wolff et al. ..... 417/269
5,215,443 A 6/1993 Hani et al.
6,092,998 A * 7/2000 Dexter et al. ..... 417/269
6,186,747 B1 * 2/2001 Zhou et al. ..... 222/321.9

FOREIGN PATENT DOCUMENTS

| | | |
|---|---|---|
| DE | 42 09 461 | 10/1993 |
| DE | 297 01 555 | 4/1997 |
| DE | 195 48 498 | 7/1997 |
| EP | 0 783 077 | 7/1997 |

* cited by examiner

*Primary Examiner*—Charles G. Freay
(74) *Attorney, Agent, or Firm*—Barry R. Lipsitz; Douglas M. McAllister

(57) ABSTRACT

In order for a high-pressure cleaner having a reciprocating pump, on which there is positioned a pump head into which at least one piston, which can be moved back and forth in the longitudinal direction of the reciprocating pump, projects, the pump head comprising a suction connection, for feeding a cleaning liquid, and a pressure connection, for discharging the cleaning liquid, accommodating a plurality of regulating valves, being produced from plastics and being braced with the reciprocating pump by means of a clamping element, to be developed such that it can be produced more cost-effectively and assembled more straightforwardly, it is proposed that the clamping element has at least one U-shaped clamping bracket with a base part butting against the pump head and with two legs which are aligned substantially in the longitudinal direction of the reciprocating pump and the free ends of which butt against an abutment surface, produced from metal, of a piston guide of the reciprocating pump and can be connected releasably to the reciprocating pump.

13 Claims, 5 Drawing Sheets

HIGH-PRESSURE CLEANER WITH CLAMPING ELEMENT FOR RECIPROCATING PUMP

This application is a continuation of international application number PCT/EP99/07831 filed on Oct. 15, 1999.

BACKGROUND OF THE INVENTION

The invention relates to a high-pressure cleaner with a reciprocating pump, on which there is positioned a pump head into which at least one piston, which can be moved back and forth in the longitudinal direction of the reciprocating pump, projects, the pump head comprising a suction connection, for feeding a cleaning liquid, and a pressure connection, for discharging the cleaning liquid, and accommodating a plurality of regulating valves, and the pump head being produced from plastics and being braced with the reciprocating pump by means of a clamping element, the clamping element having at least one U-shaped clamping bracket with a base part butting against the pump head and with two legs aligned substantially in the longitudinal direction of the reciprocating pump.

Reciprocating pumps, which can be used, for example, in high-pressure cleaners, are described in U.S. Pat. No. 5,215,443 A and DE 42 09 461 A. The reciprocating pumps each have a pump head, it being proposed in DE 42 09 461 A to use a pump head made of plastics if the pump is used for low pressures.

A high-pressure cleaner having the features specified in the introduction is known from DE 195 48 498 C2. This document proposes to produce the pump head from plastics, so that it can be produced cost-effectively and has a relatively low weight. In order for it to be possible to withstand high pressures occurring during operation of the high-pressure cleaner and the considerable mechanical loading associated therewith, the abovementioned patent specification proposes a clamping element with the aid of which the pump head can be braced with the reciprocating pump. The clamping element is formed here as a cap which is configured in the manner of a framework and has a multiplicity of cross-pieces, which extend obliquely in relation to the longitudinal axis of the reciprocating pump, and a connection pipe into which the pressure connection, formed as a pressure stub, of the pump head penetrates. Moreover, the clamping element comprises a supporting flange which butts against a step of the pressure stub and from which the cross-pieces extend in the direction of the reciprocating pump, obliquely in relation to the longitudinal axis of the reciprocating pump. The clamping element has, inter alia, a U-shaped clamping bracket with a base part butting against the pump head and with two legs aligned substantially in the longitudinal direction of the reciprocating pump. During the assembly of the high-pressure cleaner, it has to be ensured that the supporting flange of the clamping element butts against the corresponding step of the pressure stub of the pump head over the entire surface area.

DE 297 01 555 U proposes to connect a clamping element, as has been described in the abovementioned DE 195 48 498 C2, to the reciprocating pump by means of a connecting element which forms a positive fit both with the pump head and with the reciprocating pump. The use of such a connecting element, however, is associated with not inconsiderable production and assembly costs.

SUMMARY OF THE INVENTION

It is an object of the present invention to develop a high-pressure cleaner of the generic type such that it can be assembled more straightforwardly and allows a reliable connection between the pump head and reciprocating pump.

This object is achieved according to the invention, in the case of the high-pressure cleaner of the type described in the introduction, in that the free ends of the legs butt against an abutment surface, produced from metal, of a piston guide of the reciprocating pump and can be connected releasably to the reciprocating pump.

It has been found that the clamping-element design known from DE 195 48 498 C2 can be simplified to a considerable extent. All that is required in order to ensure satisfactory functioning of the pump head, produced from plastics, is for the clamping element to have at least one U-shaped clamping bracket, although it has to be ensured that the free ends of the clamping bracket butt against an metallic abutment surface of the piston guide of the reciprocating pump and are connected releasably, for example screwed, to the reciprocating pump. The clamping bracket ensures that the pump head, produced from plastics, can withstand even high pressures. For this purpose, the U-shaped clamping bracket engages around the pump head and butts directly against an abutment surface produced from metal. On account of the metallic configuration, the tightening torque to which the clamping bracket is subjected as it is fitted is maintained even during continuous operation of the high-pressure cleaner, loosening of the clamping bracket being avoided. Such loosening occurs, in particular, when the free ends of the legs of the clamping bracket butt against a plastics part since, on account of the high mechanical loading to which the plastics part is subjected by the clamping bracket, this plastics part plastifies over time, that is to say, in the case of an abutment surface produced from plastics, shrinkage takes place and results in loosening of the clamping element and thus in the functioning of the pump head, produced from plastics, being impaired. According to the invention, the abutment surface of the clamping element is thus produced from metal, so that the clamping element is prevented from loosening during the operation of the high-pressure cleaner. This, in turn, makes it possible for the clamping element to be configured with a particularly straightforward design.

The assembly of the high-pressure cleaner may additionally be simplified in that the piston guide of the reciprocating pump has through-passage openings which have connecting elements passing through them for the releasable connection of the clamping bracket to the reciprocating pump.

The reciprocating pump preferably comprises a cup-like pump housing on which the piston guide is positioned, and the clamping bracket can preferably be connected releasably to the pump housing.

Starting from the base part, which butts against the region of that end surface of the pump head which is directed away from the reciprocating pump, the legs of the clamping bracket can extend laterally in the longitudinal direction of the reciprocating pump, along the pump head, to approximately level with the pump housing.

It may alternatively be provided that the piston guide has metallic guide sleeves which are aligned in the longitudinal direction of the reciprocating pump, are directed towards the pump head and against the free ends of which the legs of the clamping bracket butt. The free ends of the guide sleeves thus form a metallic abutment surface for the clamping bracket and, since the guide sleeves are directed towards the pump head, it is possible for the length of the legs of the clamping bracket to be reduced, as a result of which a particularly stable design of the clamping element is achieved.

It is preferably provided that the connecting elements for the releasable connection of the clamping bracket to the reciprocating pump are formed as clamping screws which pass through the guide sleeves and are in engagement with a corresponding internal thread of the pump housing. The clamping bracket can be screwed to the pump housing by means of the clamping screws. In this case, the clamping screws pass through the guide sleeves of the piston guide, that is to say the connection of the clamping bracket to the pump housing simultaneously achieves mechanical securing for the piston guide.

In a design of the high-pressure cleaner which withstands particularly high mechanical loading, it is provided that the clamping screws are in engagement with an internal thread of the guide sleeves, so that the clamping element can be connected releasably to the piston guide of the reciprocating pump. Additional connecting elements are then provided for securing the piston guide mechanically on the pump housing of the reciprocating pump.

In a preferred embodiment, the clamping element has two U-shaped clamping brackets, a first clamping bracket engaging around the pump head in its lower region, adjacent to the suction connection, while the second clamping bracket engages around the pump head in its upper region, directed away from the suction connection. The use of two clamping brackets in a substantially mirror-symmetrical manner in relation to a centre plane aligned level with the pressure connection in the longitudinal direction of the reciprocating pump allows particularly uniform mechanical loading of the pump head. Tilting moments may thus be reliably prevented.

The two clamping brackets are preferably connected rigidly to one another via a connecting part since, as a result, the clamping element attains particularly high mechanical stability.

It is advantageous if the connecting element encloses the pressure connection of the pump head in the form of a ring since this simplifies the positioning of the clamping element during the assembly of the high-pressure cleaner. All that is necessary for this purpose is to position the clamping element with its connecting part on the pressure connection.

The clamping element butts against the free end surface of the pump head by way of the base parts of the two clamping brackets and, on account of the connection of the clamping element to the reciprocating pump, the pump head is subjected to a clamping force by the base parts. In an advantageous embodiment, it is provided that the connecting part has two lugs which project laterally, transversely to the longitudinal direction of the reciprocating pump, and butt against the pump head. The surface over which the clamping element butts against the pump head is increased in that this results in more uniform loading of the pump head and thus in increased mechanical stability.

It is advantageous if the clamping element is formed in one piece. This not only makes it possible to reduce the production costs, but also results in a mechanically more stable design.

The clamping element is preferably configured from metal, for example in the form of a sheet-metal part. It may alternatively be provided that the clamping element is formed as a diecasting, for example as a zinc or aluminium casting.

BRIEF DESCRIPTION OF THE DRAWINGS

The following description of preferred embodiments of the invention serves for more detailed explanation in conjunction with the drawing, in which.

DETAILED DESCRIPTION OF THE INVENTION

Figure 1:
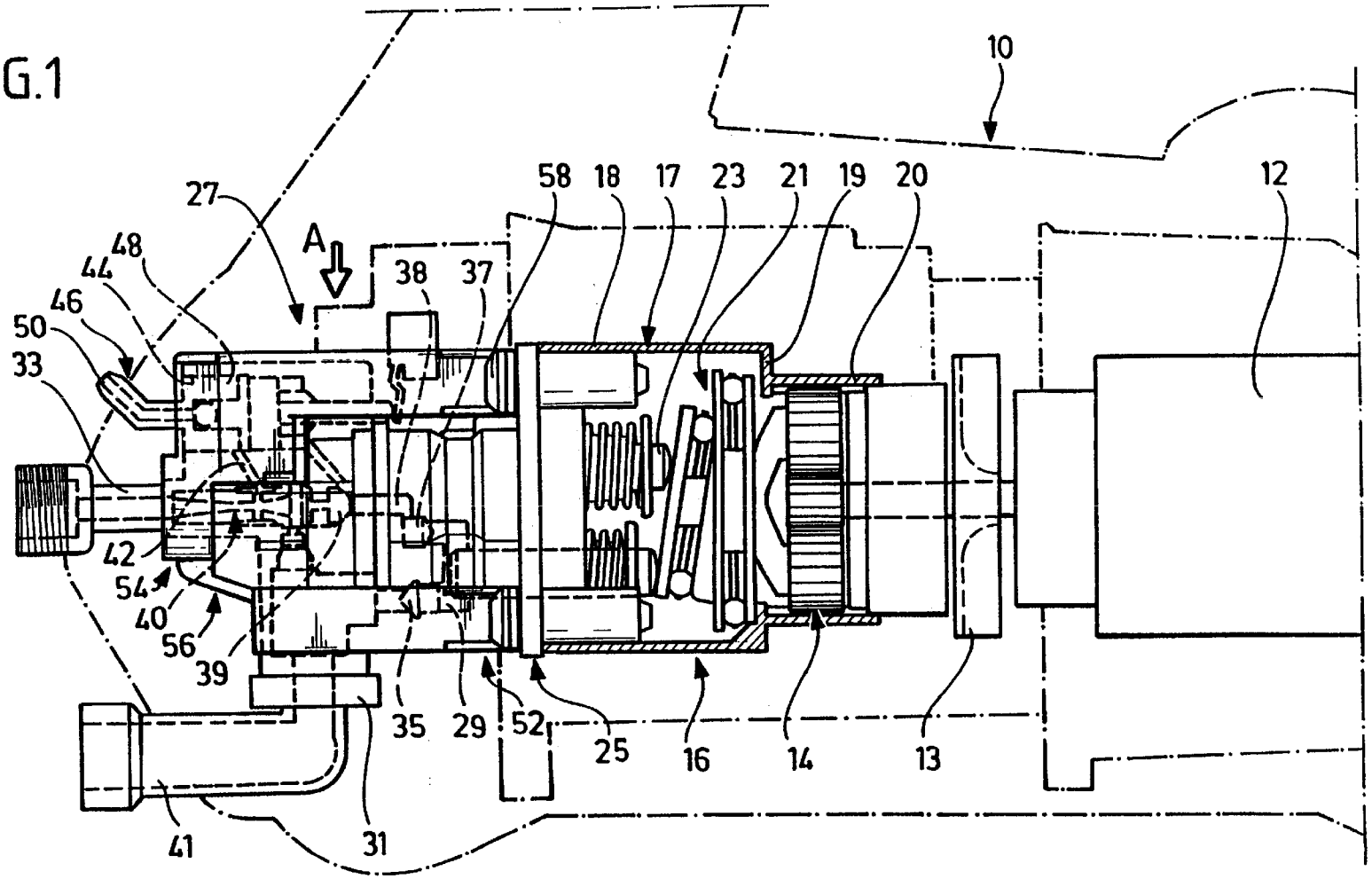
FIG. 1 shows a schematic longitudinal section of a high-pressure cleaner.

FIG. 1 illustrates a high-pressure cleaner which is designated overall by the reference numeral 10 and has an electric motor 12, on the end side of which a reciprocating pump 16 is flange-connected via a fan 13 and a gear mechanism 14. This reciprocating pump comprises a pump housing 17 which is configured approximately in the form of a pot and has a cylindrical housing casing 18 and a housing base 19, to which a collar 20, which encloses the gear mechanism 14 in the circumferential direction is applied. Positioned within the pump housing 17 is a swash plate 21 against which a plurality of pistons 23 butt, these pistons moving back and forth in the longitudinal direction of the reciprocating pump 16 on account of the rotary movement of the swash plate 21.

The reciprocating pump 16 also comprises a piston guide 25, which is positioned on the cup-like pump housing 17 and forms a guide for the pistons 23.

A pump head 27 is positioned on the piston guide 25 of the reciprocating pump 16. This pump head comprises a pumping chamber 29 (only schematically illustrated in the drawing) into which the pistons 23 penetrate. The pump head 27 also has a suction connection 31 and a pressure connection configured as a pressure stub 33. The suction connection is in flow connection, via a suction valve 35, with the pumping chamber 29, which, in turn, is connected to a pressure chamber 38 via a pressure valve 37. The pressure chamber 38 is in flow connection with the pressure stub 33 via a nonreturn valve 39 and an injector 40.

During the operation of the high-pressure cleaner, a cleaning liquid, for example water, can be fed to the pump head 37 via a suction stub 41 which opens out into the suction connection 31. From the suction connection 31, the cleaning liquid flows, via the suction valve 35, into the pumping chamber 29 and is then pumped into the pressure stub 33 under high pressure via the pressure valve 37 and the nonreturn valve 39.

The injector 40 forms a narrowing of the flow cross-section of the pressurized cleaning liquid, and, at the location of the narrowest cross-section, a transverse bore 42 produces a connection between the injector 40 and at chemical connection 44, into which a chemical line 46 penetrates by way of a widened connection element 48, while a connection nipple 50 projects out of the chemical connection 44.

Figure 6:
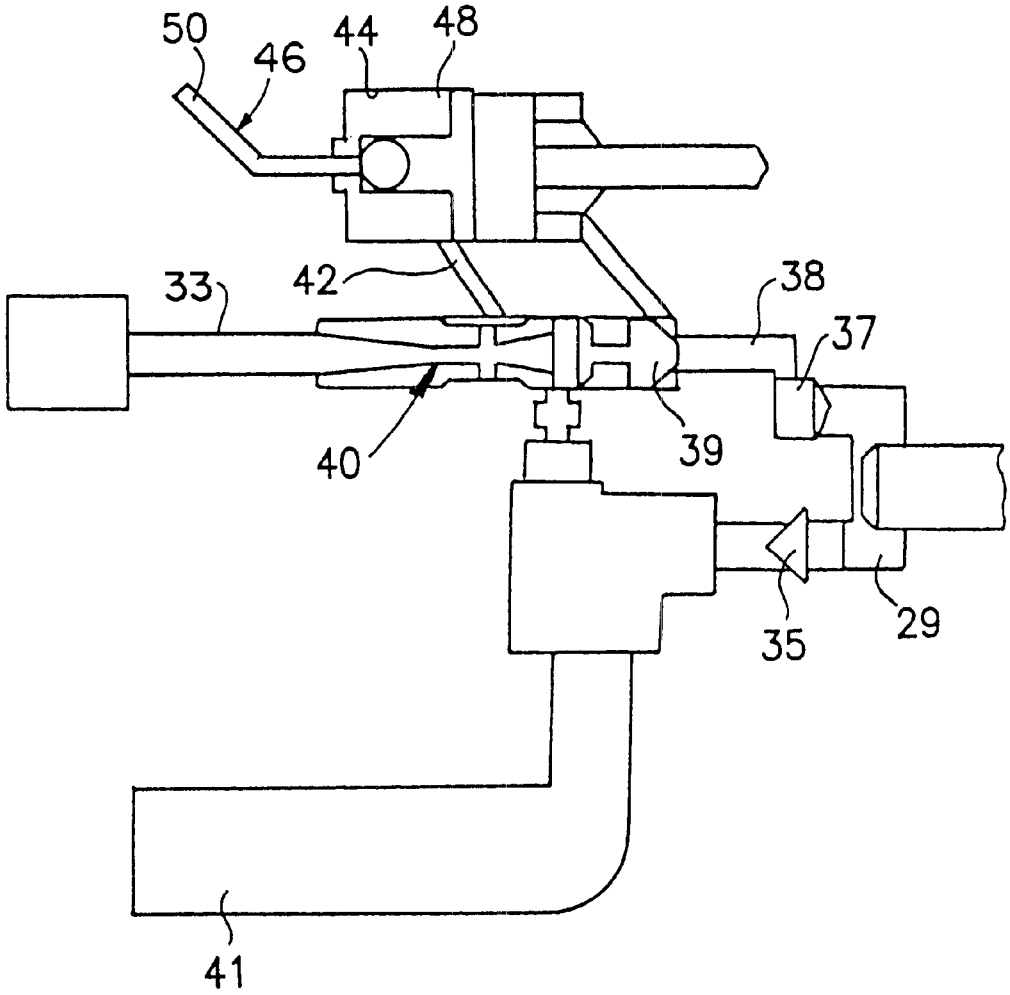
FIG. 6 shows a view of the components of the fluid flow path of the FIG. 1 embodiment of the invention.

For clarity, FIG. 6 shows only those components of FIG. 1 involved in the above-described fluid flow path through the pump (i.e. the components shown in dashed lines in FIG. 1). Like reference numerals denote like elements in the Figures.

Figure 3:
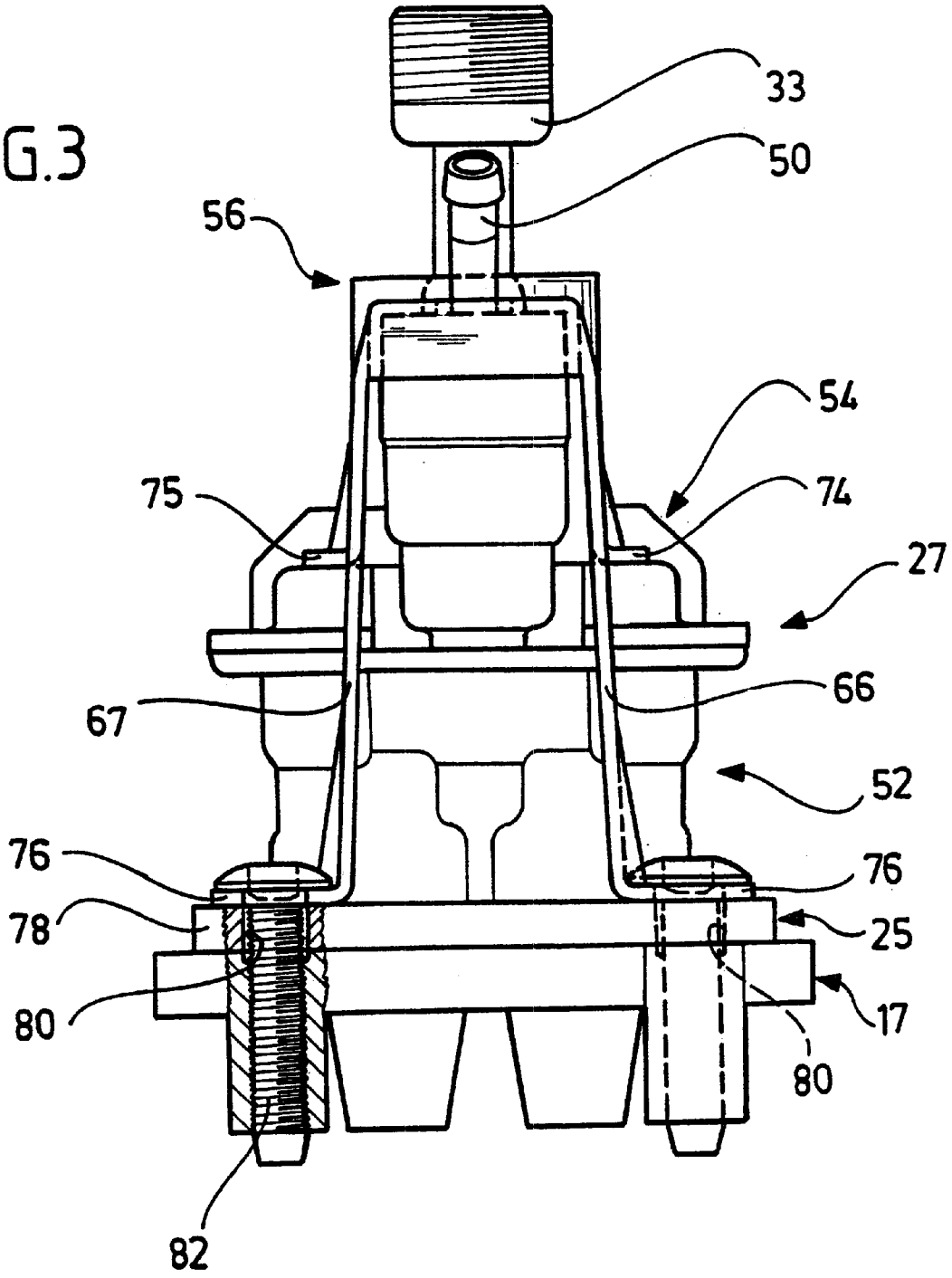
FIG. 3 shows a view of the high-pressure cleaner in the direction of the arrow A from FIG. 1 with a clamping element according to a first embodiment of the invention.

As is clear, in particular, from FIG. 3, the pump head 27 is produced from plastics, for example from a polyamide, and is formed in two parts. A first part of the pump head forms a cylinder head 52, which has the pumping chamber 29 and accommodates the suction valve 35 and the pressure valve 37. The second part of the pump head 27 is formed by a regulating housing 54, which has the suction connection 31 and the pressure stub 33 and the chemical connection 44 and accommodates the nonreturn valve 39 and the injector 40 and the chemical line 46.

The axial forces occurring during the operation of the high-pressure cleaner 10, and acting in the longitudinal direction of the reciprocating pump 16, are absorbed by a clamping element 56 disposed on the free end surface of the pump head 27, this free end surface being directed away from the reciprocating pump 16. As is explained in yet more detail hereinbelow, this clamping element is screwed to the reciprocating pump 16 by means of clamping screws 58.

Figure 2:
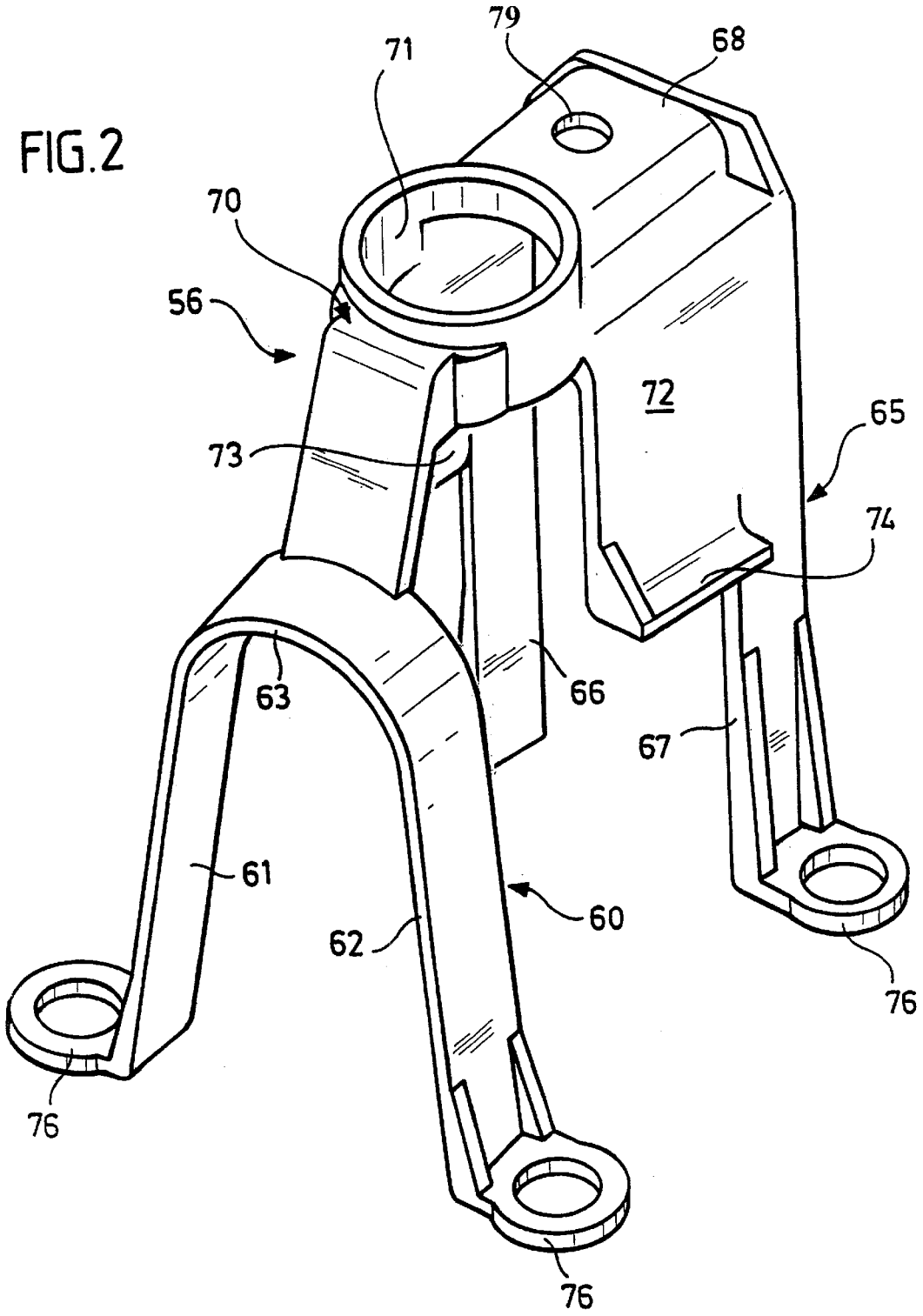
FIG. 2 shows a perspective illustration of a clamping element used in the high-pressure cleaner from FIG. 1.

The clamping element 56 is illustrated in perspective in FIG. 2. It comprises a first, substantially U-shaped clamping bracket 60, with two legs 61, 62 aligned approximately in the longitudinal direction of the reciprocating pump 16 and with a curved base part 63, and a second, likewise substantially U-shaped clamping bracket 65, with legs 66, 67 and with a base part 68. The two base parts 63 and 68 are connected to one another via a rigid connecting part 70 which has a through-passage bore 71 and side walls 72, 73 which are aligned parallel to the legs 66, 67 of the second clamping bracket 65 and at the free end regions of which there project retaining lugs 74, 75, which are aligned transversely to the longitudinal direction of the reciprocating pump 16.

The free ends of the legs 66, 67 and 61, 62 are configured in each case as retaining rings 76 aligned transversely to the longitudinal direction of the reciprocating pump 16.

During assembly of the high-pressure cleaner 10, the clamping element 56 may be positioned on the free end surface of the pump head 27 such that the pressure stub 33 passes through the through-passage bore 71 and the curved base part 63 of the first clamping bracket 60 butts against the pump head 27 in the region of the suction connection 31, while the base part 68 of the second clamping bracket 65 comes into abutment against the pump head 27 in the region of the chemical connection 44. In order to allow access to the chemical connection 44, the base part 68 of the second clamping bracket 65 has a bore 79, which has the connection nipple 50 of the chemical line 46 passing through it. The pump head 27 thus has a clamping bracket engaging around it in each case both in its lower region, adjacent to the suction connection 31, and in its upper region, directed away from the suction connection 31 and adjacent to the chemical connection 44. In addition, the retaining lugs 74, 75 of the connecting part 70 come into abutment against the end side of the pump head 27. The pump head 27 is thus supported in the axial direction of the high-pressure cleaner in the region of the base parts 63 and 68 and of the retaining lugs 74, 75, and the axial forces occurring in the pump head 27 are absorbed by the clamping element 56.

Figure 4:
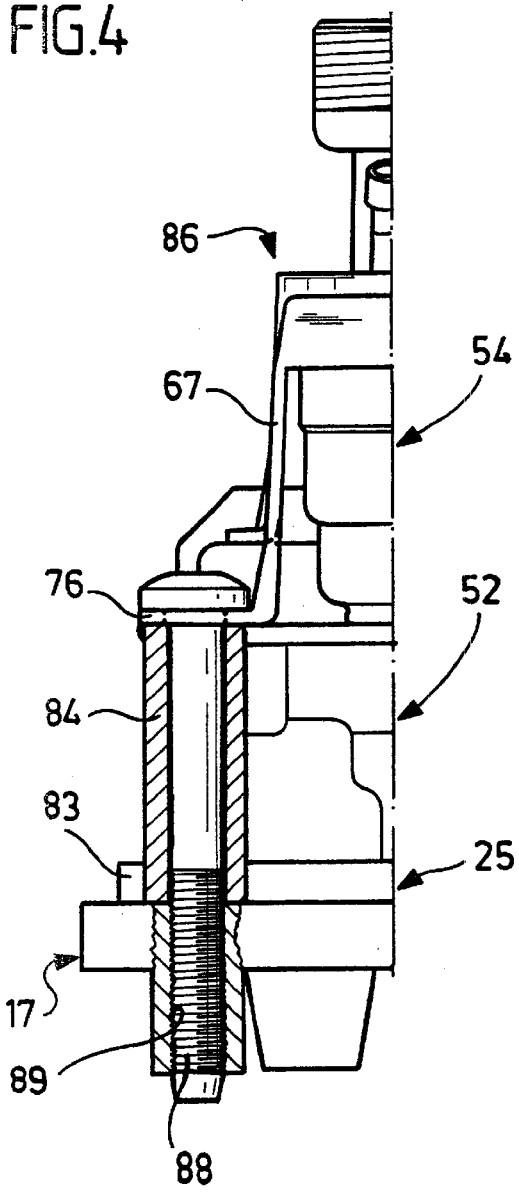
FIG. 4 shows a view corresponding to FIG. 3 with a clamping element according to a second embodiment of the invention.
Figure 5:
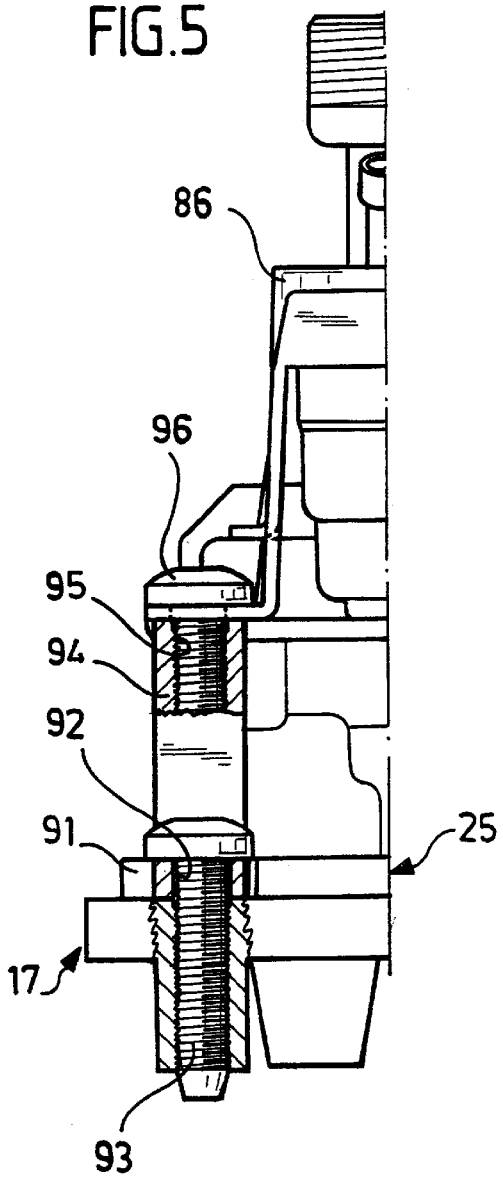
FIG. 5 shows a view corresponding to FIG. 3 with a clamping element according to a third embodiment of the invention.

The fastening of the clamping element 56 on the reciprocating pump 16 is illustrated in detail in FIGS. 3, 4 and 5, it being possible to use clamping elements 56 of different configurations.

According to a first embodiment, which is illustrated in FIG. 3, the legs of the two clamping brackets of the clamping element 56 extend substantially along the entire pump head 27, that is to say along both the regulating housing 54 and the cylinder head 52.

As has already been explained, the reciprocating pump 16 comprises a pump housing 17 on which the piston guide 25 is positioned. For this purpose, the piston guide 25 has a guide flange 78, which is produced from metal and constitutes an abutment surface for the clamping element 56.

In the first exemplary embodiment, which is illustrated in FIG. 3, the guide flange 78 comprises through-passage bores 80 which have clamping screws 82 passing through them. The clamping element 56 can be screwed to the pump housing 17 with the aid of the clamping screws 82.

A second embodiment of the high-pressure cleaner 10 is illustrated in FIG. 4. This differs from the configuration described above in that, for the piston guide 25, use is made of a guide flange 83 with metallic guide sleeves 84 which, starting from the pump housing 17, extend along the cylinder head 52. A clamping element 86 butts, by way of its retaining rings 76, against the free end surfaces of the guide sleeves 84, this clamping element differing from the clamping element 56 described above solely by the fact that the legs 61, 62 and 66, 67 are shortened and only run along the regulating housing 54 of the pump head 27. On account of the shortened configuration of the legs, the clamping element 86 is distinguished by a more compact configuration and, accordingly, by higher mechanical stability. The fastening of the clamping element 86 on the pump housing 17 takes place by means of clamping screws 88, which pass through the guide sleeves 84 and are in engagement with an internal thread 89 of the pump housing 17. In addition to fastening the clamping element 86, the clamping screws 88 thus also serve for securing the guide flange 83 of the piston guide 25.

A third embodiment of a high-pressure cleaner is illustrated in FIG. 5. This likewise has a clamping element 86, as has already been described with reference to FIG. 4. In contrast to the second embodiment, however, in the configuration illustrated in FIG. 5, a guide flange 91 is provided for the piston guide 25, this guide flange having both through-passage bores 92, for the through-passage of fastening screws 93, and guide sleeves 94, which comprise an internal thread 95 and are in engagement with clamping screws 96. In the third embodiment, which is illustrated in FIG. 5, the clamping element 86 is fastened on the guide sleeves 94 of the guide flange 91 by means of the clamping screws 96. The fastening of the guide flange 91, in turn, takes place by means of separate fastening screws 93, which are offset in the circumferential direction of the guide flange 91 in relation to the guide sleeves 94.

In all three embodiments of the high-pressure cleaner described above, it is provided that the clamping element 56 or 86 comes into abutment directly against a metallic abutment surface in the form of the guide flange 78 or of the guide flanges 83 and 91, respectively. The releasable connection of the clamping element 56 or 86 takes place by means of clamping screws 82, 88, 93, in which case, by virtue of the metallic configuration of the respective abutment surface, it is possible for the clamping element 56 or 86 to be subjected to a high tightening torque and it is ensured that the clamping element does not loosen during the operation of the high-pressure cleaner 10. The axial forces occurring in the pump head 27, which is produced in two parts from plastics, are thus reliably absorbed by the clamping element 56 or 86 and transmitted to the pump housing 17.

What is claimed is:

1. A high-pressure cleaner comprising:

a reciprocating pump, on which there is positioned a pump head into which at least one piston, which can be moved back and forth in a longitudinal direction of the reciprocating pump, projects, said pump head comprising a suction connection for feeding a cleaning liquid, and a pressure connection for discharging the cleaning liquid, and accommodating a plurality of regulating valves, said pump head being produced from plastic and being clamped to the reciprocating pump by means of a clamping element, said clamping element having at least one U-shaped clamping bracket with a base part butting against the pump head and with two legs aligned substantially in the longitudinal direction of the reciprocating pump, wherein free ends of the legs butt against a metal abutment surface of a piston guide of the reciprocating pump and said free ends of the legs are adapted to be releasably connected to the reciprocating pump.

2. A high-pressure cleaner according to claim 1, wherein the piston guide has through-passage openings which have connecting elements passing through them for the releasable connection of the clamping bracket to the reciprocating pump.

3. A high-pressure cleaner according to claim 1, wherein:

the reciprocating pump comprises a cup-like pump housing on which the piston guide is positioned, and the clamping bracket is releasably connectable to the pump housing.

4. A high-pressure cleaner according to claim 1, wherein the piston guide has metallic guide sleeves which are aligned in the longitudinal direction of the reciprocating pump, and are directed towards the pump head and against the free ends of the clamping bracket legs.

5. A high-pressure cleaner according to claim 4, wherein the connecting elements for the releasable connection of the clamping bracket to the reciprocating pump are formed as clamping screws which pass through the guide sleeves and are in engagement with a corresponding internal thread of the pump housing.

6. A high-pressure cleaner according to claim 4, wherein:

the connecting elements for the releasable connection of the clamping bracket to the reciprocating pump comprise clamping screws, and the guide sleeves have an internal thread for engaging the clamping screws.

7. A high-pressure cleaner according to claim 1, wherein:

the clamping element has two U-shaped clamping brackets, a first one of said brackets engaging around a lower region of the pump head, adjacent to the suction connection, and the second one of said brackets engaging around an upper region of the pump head, directed away from the suction connection.

8. A high-pressure cleaner according to claim 7, wherein the clamping element comprises a connecting part which rigidly connects the two clamping brackets to one another.

9. A high-pressure cleaner according to claim 8, wherein the connecting part encloses the pressure connection in the form of a ring.

10. A high-pressure cleaner according to claim 8, wherein the connecting part has two lugs which project laterally, transversely to the longitudinal direction of the reciprocating pump, and butt against the pump head.

11. A high-pressure cleaner according to claim 1, wherein the clamping element is formed in one piece.

12. A high-pressure cleaner according to claim 1, wherein the clamping element is produced from metal.

13. A high-pressure cleaner according to claim 1, wherein the clamping element comprises a sheet-metal part.

* * * * *